US011066871B2

(12) United States Patent
Wang

(10) Patent No.: US 11,066,871 B2
(45) Date of Patent: Jul. 20, 2021

(54) RETRACTABLE SAFETY GATE

(71) Applicant: DEMBY DEVELOPMENT CO., LTD., New Taipei (TW)

(72) Inventor: Tsung-Hsiang Wang, New Taipei (TW)

(73) Assignee: Demby Development Co., Ltd., New Taipei (TW)

( * ) Notice: Subject to any disclaimer, the term of this patent is extended or adjusted under 35 U.S.C. 154(b) by 384 days.

(21) Appl. No.: 16/122,951

(22) Filed: Sep. 6, 2018

(65) Prior Publication Data

US 2019/0078382 A1 Mar. 14, 2019

(30) Foreign Application Priority Data

Sep. 12, 2017 (CN) ..... 201721166233.4

(51) Int. Cl.

| | |
|---|---|
| ***E06B 9/08*** | (2006.01) |
| ***E06B 9/17*** | (2006.01) |
| ***E06B 9/60*** | (2006.01) |
| ***E06B 9/13*** | (2006.01) |
| ***E06B 9/174*** | (2006.01) |
| *E06B 9/00* | (2006.01) |

(52) U.S. Cl.

CPC ..... *E06B 9/08* (2013.01); *E06B 9/13* (2013.01); *E06B 9/174* (2013.01); *E06B 9/17046* (2013.01); *E06B 9/60* (2013.01); *E06B 2009/002* (2013.01)

(58) Field of Classification Search

CPC ..... E06B 9/08; E06B 11/04; E06B 11/026; E06B 2009/002; E06B 2009/543; E06B 9/13; E06B 9/17046; E06B 9/174; E06B 9/60

See application file for complete search history.

(56) References Cited

U.S. PATENT DOCUMENTS

| | | | | |
|---|---|---|---|---|
| 7,438,112 | B2 * | 10/2008 | Cheng | E01F 13/028 160/24 |
| 9,598,896 | B1 * | 3/2017 | Pichik | E06B 9/13 |
| 2011/0088323 | A1 * | 4/2011 | Lundh | E06B 9/08 49/57 |
| 2013/0299101 | A1 * | 11/2013 | Wang | E06B 9/13 160/303 |

(Continued)

*Primary Examiner* — Daniel P Cahn
*Assistant Examiner* — Poras Pradipkumar Patel
(74) *Attorney, Agent, or Firm* — Alan D. Kamrath; Karin L. Williams; Mayer & Wiilliams PC

(57) ABSTRACT

A retractable safety gate has a mesh fabric, a retracting mechanism connected with a first side of the mesh fabric, and a fastening mechanism connected with a second side of the mesh fabric. The retracting mechanism includes a bottom bracket, a fastening bracket, a first mounting tube, a locking assembly, and an energy storage assembly. The first mounting tube is rotatably mounted in the bottom bracket and the fastening bracket. The mesh fabric is wound around the first mounting tube. The locking assembly is mounted on the first mounting tube and selectively engages with the fastening bracket. The energy storage assembly is mounted in the first mounting tube and provides a resilient restoring force that drives the first mounting tube to wind the mesh fabric around the first mounting tube. The retractable safety gate rolls the mesh fabric up automatically and is convenient for use.

8 Claims, 19 Drawing Sheets

(56) References Cited

U.S. PATENT DOCUMENTS

| | | | | |
|---|---|---|---|---|
| 2018/0044982 | A1* | 2/2018 | Wang | E06B 9/08 |
| 2019/0301242 | A1* | 10/2019 | Shipman | E06B 9/58 |
| 2020/0063488 | A1* | 2/2020 | Wang | E05B 63/0008 |

* cited by examiner

400

RETRACTABLE SAFETY GATE

CROSS-REFERENCE TO RELATED APPLICATIONS

This application is based upon and claims priority under 35 U.S.C. 119 from China Utility Model Application No. 201721166233.4 filed on Sep. 12, 2017, which is hereby specifically incorporated herein by this reference thereto.

BACKGROUND OF THE INVENTION

1. Field of the Invention

The present invention relates to a safety gate, especially to a retractable safety gate.

2. Description of the Prior Art(s)

Generally, a safety gate is placed across passageways to block access to a specific area such as kitchen, bathroom, stairway, garden, and the like, and is usually used for preventing babies or toddlers from accessing dangerous areas or preventing pets from entering specific areas.

A conventional retractable safety gate comprises a retracting mechanism with an unlocking member, a fastening mechanism with an unlocking member, and a mesh fabric connected between the retracting mechanism and the fastening mechanism. When the retracting mechanism is unlocked, the mesh fabric can be retracted or expanded, so as to adjust a blocking width of the conventional safety gate. When the fastening mechanism is unlocked, the conventional safety gate can be opened. However, since the conventional retractable safety gate is controlled manually, a user has to roll the mesh fabric up by hand when closing the conventional safety gate, which is inconvenient.

To overcome the shortcomings, the present invention provides a retractable safety gate to mitigate or obviate the aforementioned problems.

SUMMARY OF THE INVENTION

The main objective of the present invention is to provide a retractable safety gate that has a mesh fabric, a retracting mechanism, and a fastening mechanism. The mesh fabric has a first side connected with the retracting mechanism and a second side connected with the fastening mechanism. The retracting mechanism includes a bottom bracket, a fastening bracket, a locking assembly, and an energy storage assembly.

The first mounting tube is disposed between the bottom bracket and the fastening bracket, and has a lower end rotatably mounted in the bottom bracket and an upper end rotatably mounted in the fastening bracket. The first side of the mesh fabric is connected to and is wound around the first mounting tube.

The locking assembly is mounted on the upper end of the first mounting tube and selectively engages with the fastening bracket. The locking assembly disengages from the fastening bracket when adjusting an expanded length of the mesh fabric. The expanded length of the mesh fabric is fixed when the locking assembly engages with the fastening bracket.

The energy storage assembly is mounted in the first mounting tube and includes a central tube, a transmission element, and a resilient element. The central tube has a lower end securely connected to the bottom bracket. The transmission element is rotatably mounted around the central tube and is securely connected with the first mounting tube. The resilient element has two ends connected to the central tube and the transmission member respectively. A resilient restoring force is formed when the resilient element is deformed. The resilient restoring force drives the first mounting tube to rotate to wind the mesh fabric around the first mounting tube.

When expanding the mesh fabric, the mesh fabric drives the first mounting tube to rotate relative to the fastening bracket and the bottom bracket, and the transmission element rotates along with the first mounting tube. Since the central tube is securely connected to the bottom bracket and remains static, the upper end of the resilient element is also static and the lower end of the resilient element is driven to rotate by the transmission element. Accordingly, the resilient element is twisted and deformed, and the potential energy is stored in the resilient element.

When rolling the mesh fabric up, the second side of the mesh fabric, which is attached to the wall via the fastening mechanism, is released, and the resilient element with the potential energy stored therein forms a resilient restoring force to drive the transmission element and the first mounting tube to rotate reversely. Hence, the mesh fabric is wound around the first mounting tube automatically. A user does not need to rotate the first mounting tube by hand, which is convenient and fast.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
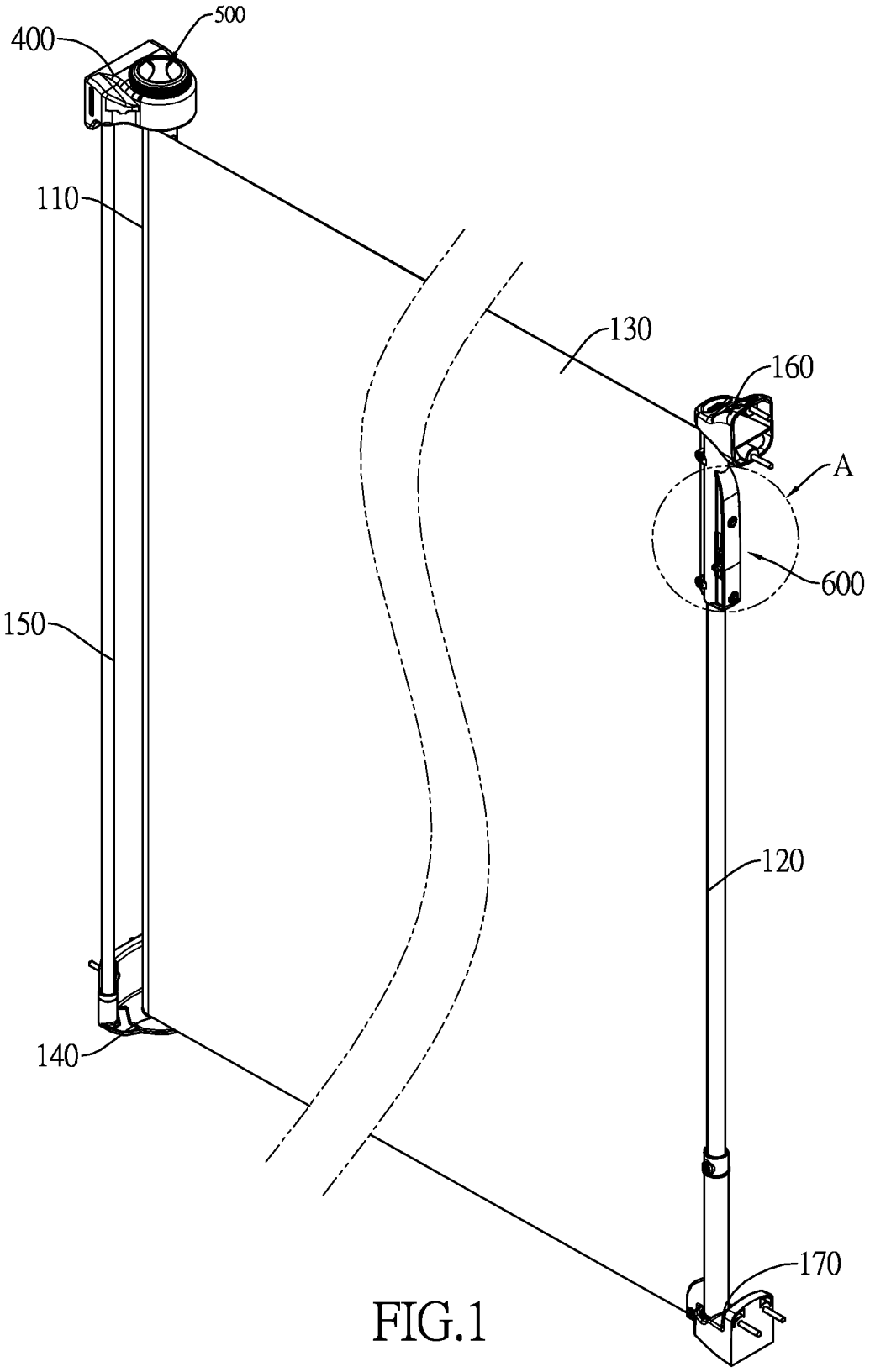
FIG. 1 is a perspective view of a retractable safety gate in accordance with the present invention.
Figure 2:
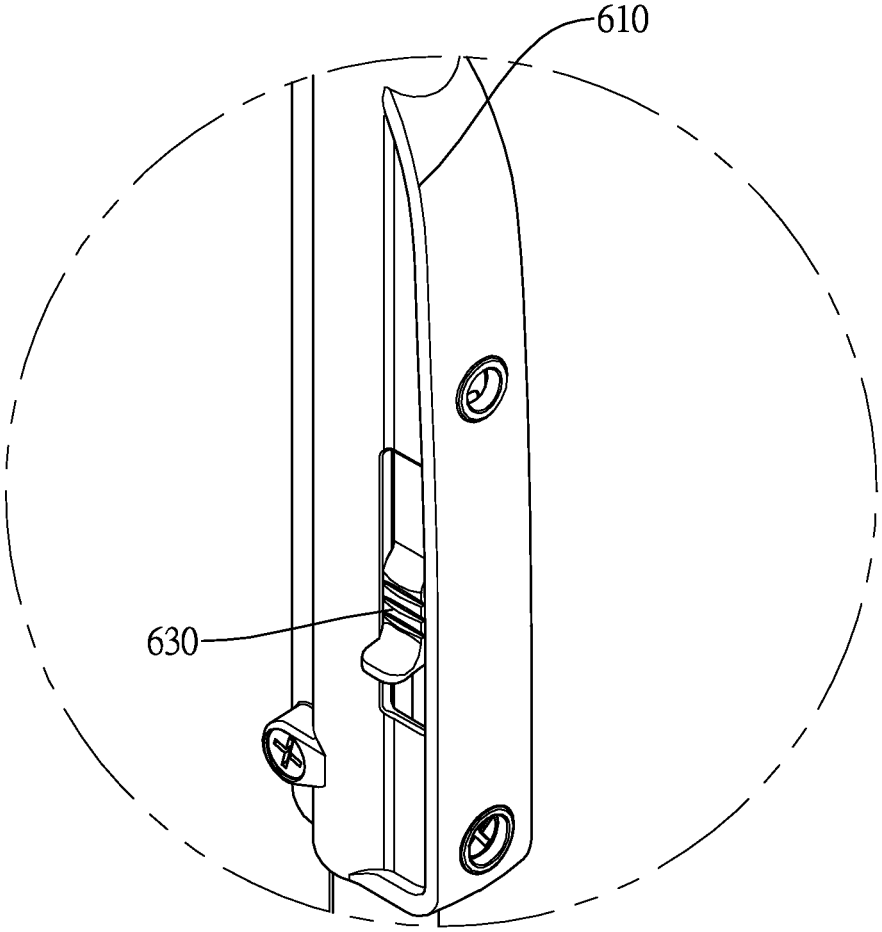
FIG. 2 is an enlarged perspective view of an A portion of the retractable safety gate encircled in FIG. 1.
Figure 3:
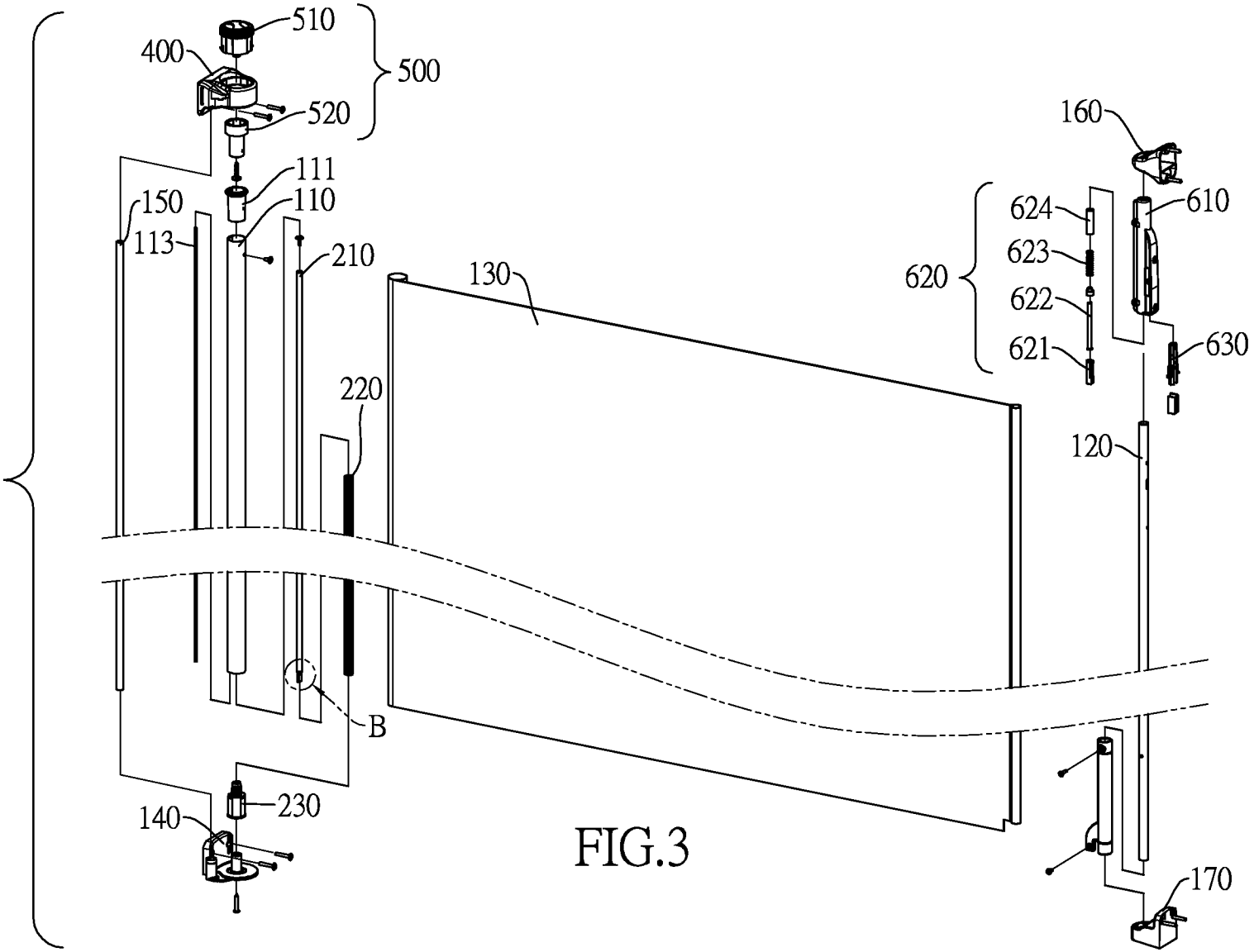
FIG. 3 is an exploded perspective view of the safety gate in FIG. 1.

With reference to FIGS. 1 and 3, a retractable safety gate in accordance with the present invention comprises a mesh fabric 130, a retracting mechanism, and a fastening mechanism. The mesh fabric 130 has a first side and a second side being opposite to the first side of the mesh fabric. The first side of the mesh fabric 130 is connected with the retracting mechanism. The second side of the mesh fabric 130 is connected with the fastening mechanism. The retracting mechanism and the fastening mechanism are respectively mounted on two opposite walls or two opposite barriers. Thus, the mesh fabric 130 is able to block a passageway between the two walls or the two barriers.

Figure 5:
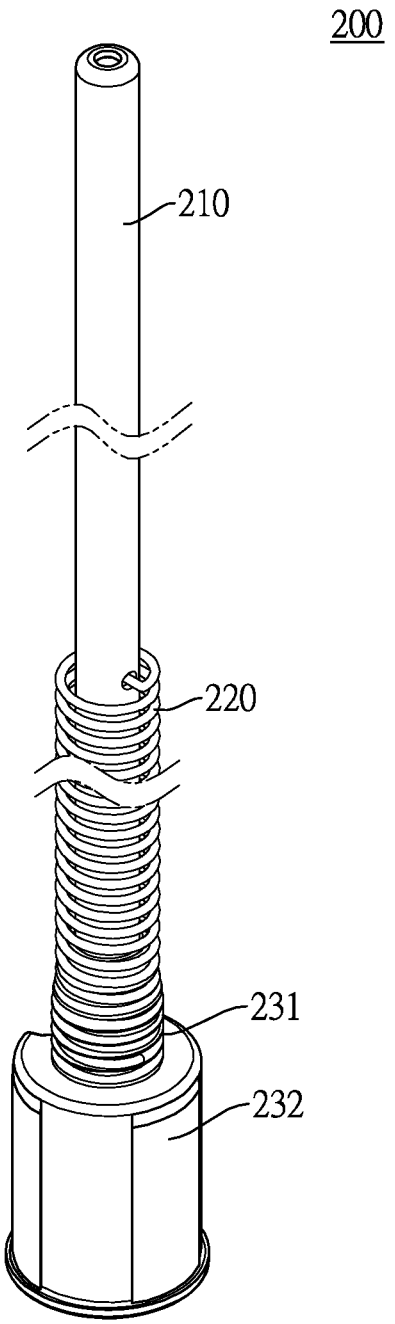
FIG. 5 is a perspective view of an energy storage assembly of the retractable safety gate in FIG. 1.
Figure 6:
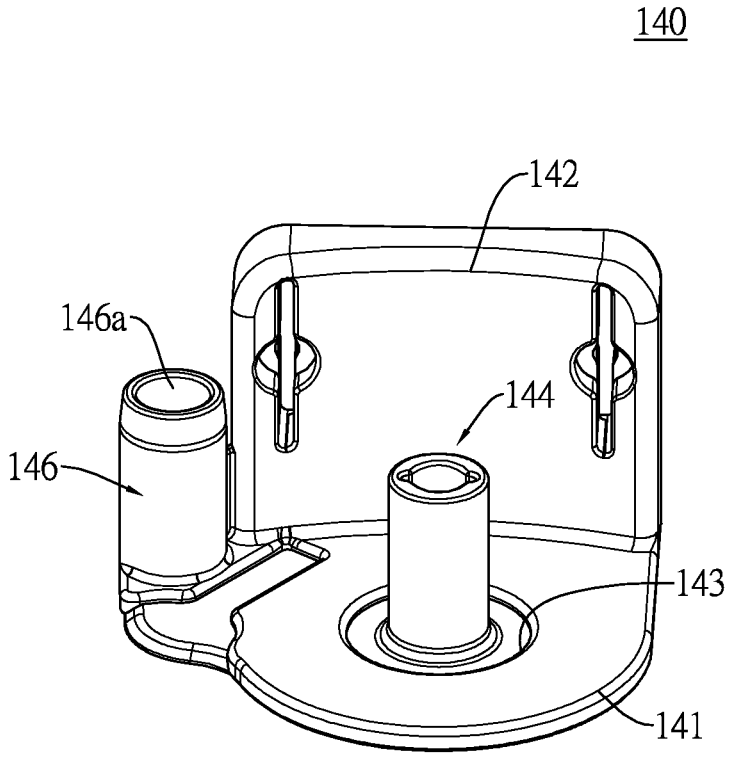
FIG. 6 is a perspective view of a bottom bracket of the retractable safety gate in FIG. 1.

With reference to FIGS. 1, 3, and 5, the retracting mechanism includes a bottom bracket 140, a fastening bracket 400, a first mounting tube 110, an energy storage assembly 200, and a locking assembly 500. The bottom bracket 140 and the fastening bracket 400 are separately fixed onto one of the walls or one of the barriers. The first mounting tube 110 is disposed between the bottom bracket 140 and the fastening bracket 400 and has a lower end rotatably mounted in the bottom bracket 140 and an upper end rotatably mounted in the fastening bracket 400. Hence, the retracting mechanism is mounted onto the wall or the barrier via the bottom bracket 140 and the fastening bracket 400. The first side of the mesh fabric 130 is wound around the first mounting tube 110. The energy storage assembly 200 is mounted in the first mounting tube 110. The locking assembly 500 is mounted on the upper end of the first mounting tube 110 and selectively engages with the fastening bracket 400. The fastening bracket 400 and the first mounting tube 110 are locked with each other or are unlocked from each other via the locking assembly 500.

When the fastening bracket 400 and the first mounting tube 110 are locked, the first mounting tube 110 is unable to rotate relative to the fastening bracket 400. Thus, the mesh fabric 130 wound around the first mounting tube 110 is unable to be released or rolled up.

When the fastening bracket 400 and the first mounting tube 110 are unlocked, the first mounting tube 110 is able to rotate relative to the fastening bracket 400 by being pulled with an external force, so as to release the mesh fabric 130 wound around the first mounting tube 110. Meanwhile, potential energy is stored in the energy storage assembly 200 in the first mounting tube 110. When the external force is removed, the potential energy stored in the energy storage assembly 200 drives the first mounting tube 110 to rotate reversely relative to the fastening bracket 400, so as to roll the mesh fabric 130 up automatically.

Specifically, the energy storage assembly 200 includes a central tube 210, a transmission element 230, and a resilient element 220. The central tube 210 is mounted in the first mounting tube 110 and has a lower end securely connected to the bottom bracket 140. The transmission element 230 is rotatably mounted on the bottom bracket 140 and is securely connected with the first mounting tube 110. The resilient element 220 has an upper end securely connected to the central tube 210 and a lower end securely connected to the transmission element 230.

When expanding the mesh fabric 130, the mesh fabric 130 drives the first mounting tube 110 to rotate relative to the fastening bracket 400 and the bottom bracket 140, and the transmission element 230 rotates along with the first mounting tube 110. Since the central tube 210 is securely connected to the bottom bracket 140 and remains static, the upper end of the resilient element 220 is also static and the lower end of the resilient element 220 is driven to rotate by the transmission element 230. Accordingly, the resilient element 220 is twisted and deformed, and the potential energy is stored in the resilient element 220.

When rolling the mesh fabric 130 up, the second side of the mesh fabric 130, which is attached to the wall via the fastening mechanism, is released, and the resilient element 220 with the potential energy stored therein forms a resilient restoring force to drive the transmission element 230 and the first mounting tube 110 to rotate reversely. Hence, the mesh fabric 130 is wound around the first mounting tube 110 automatically. A user does not need to rotate the first mounting tube 110 by hand, which is convenient and fast.

Figure 15:
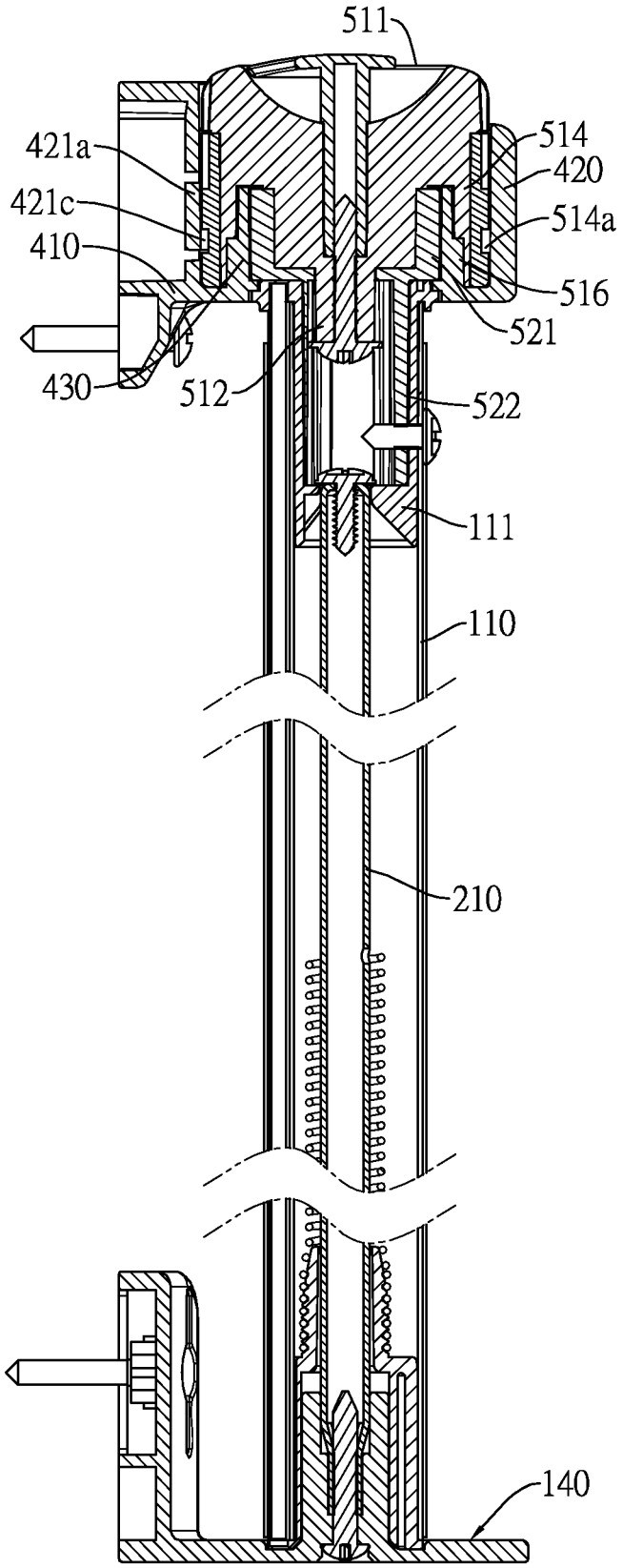
FIG. 15 is a cross-sectional side view of a retracting mechanism of the retractable safety gate in FIG. 1.

An upper end of the central tube 210 may be suspended in the first mounting tube 10, or alternatively may be rotatably connected with the first mounting tube 110 lest the central tube 210 should interfere with rotation of the first mounting tube 110. With further reference to FIG. 15, in a preferred embodiment, a tube plug 111 is mounted in the upper end of the first mounting tube 110 and is securely connected with the first mounting tube 110. Specifically, a screw is mounted through a sidewall of the first mounting tube 110 and a sidewall of the tub plug 111, such that the tube plug 111 is fixed to the first mounting tube 110. The upper end of the central tube 210 is rotatably connected to the tube plug 111. In the preferred, a threaded hole is formed in the upper end of the central tube 210. A screw is mounted through the tube plug 111 and engages in the threaded hole.

With reference to FIG. 5, the transmission element 230 includes a first mounting portion 231 and a second mounting portion 232. The first mounting portion 231 is securely connected with the lower end of the resilient element 220. The second mounting portion 232 abuts against the sidewall of the first mounting tube 110. In the preferred embodiment, the resilient element 220 is a torsion spring, and the central tube 210 has a hole formed through the sidewall of the central tube 210. The upper end of the torsion spring protrudes into the hole of the central tube 210, such that the torsion spring is connected with the central tube 210. The first mounting portion 231 is formed with a thread and the lower end of the torsion spring is screwed to the first mounting portion 231. In another preferred embodiment, the resilient element 220 may be a mainspring.

Figure 4:
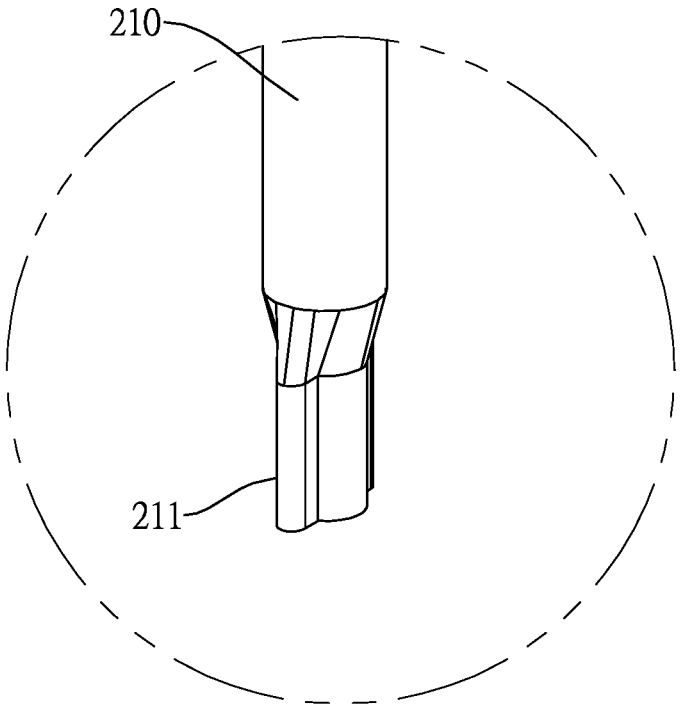
FIG. 4 is an enlarged perspective view of a B portion of the retractable safety gate encircled in FIG. 3.

With reference to FIGS. 1, 6, 7, and 15, the bottom bracket 140 is mounted to the lower end of the first mounting tube 110. The lower end of the central tube 210 is securely connected to the bottom bracket 140. The retracting mechanism of the retractable safety gate is securely mounted on the wall or the barrier via the bottom bracket 140 and the fastening bracket 400. The bottom bracket 140 has a fastening panel 141, an abutting panel 142, an indentation 143, a locating post 144, a stepped hole 145. The abutting panel 142 joins and is perpendicular to the fastening panel 141. The indentation 143 is formed in the fastening panel 141. The locating post 144 of the bottom bracket 140 protrudes up from an inner bottom defined in the indentation 143. The stepped hole 145 is formed in the locating post 144 of the bottom bracket 140. The lower end of the central tube 210 is mounted in the stepped hole 145 and is placed on an inner bottom defined in the stepped hole 145. With further reference to FIG. 4, the central tube 210 further has two positioning ears 211 formed on the lower end of the central tube 210. The stepped hole 145 corresponds in shape to the lower end of the central tube 210. The positioning ears 211 are fitted in the stepped hole 145, so as to avoid the central tube 210 and the bottom bracket 140 from rotating relative to each other.

The transmission element 230 is mounted around the locating post 144 of the bottom bracket 140, such that the transmission element 230 is positioned on the bottom bracket 140 by the locating post 144 of the bottom bracket 140. It can be understood that an outer sidewall of the first mounting tube 110 contacts with an inner sidewall defined around the indentation 143, such that the first mounting tube 110 can be placed at a specific position conveniently. Two fastening holes are formed through the abutting panel 142 of the bottom bracket 140. By mounting two screws through the two fastening holes respectively, the bottom bracket 140 can be securely attached to the wall or the barrier.

With reference to FIGS. 1, 8 to 11, the fastening bracket 400 is securely mounted to the wall or the barrier and is fitted with the first mounting tube 110 via the locking assembly 500. Specifically, the fastening bracket 400 has an outer sleeve 420, an inner sleeve 430, an upper end surface 410, a mounting hole 411, and an external gear 431. The inner sleeve 430 is coaxially surrounded by the outer sleeve 420. The upper end surface 410 is defined under the outer sleeve 420 and the inner sleeve 430, and faces the bottom bracket 140. The mounting hole 411 is formed through the upper end surface 410 of the fastening bracket 400. The locking assembly 500 is mounted through the mounting hole 411 of the fastening bracket 400 and is connected to the tube plug 111 that is mounted in the upper end of the first mounting tube 110. The external gear 431 is formed around an outer sidewall of the inner sleeve 430.

A locking latch 421 is mounted on the outer sleeve 420. In the preferred embodiment, the locking latch 421 and the outer sleeve 420 are integrally formed as a single part. For instance, a U-shaped recess 422 is formed in an outer sidewall of the outer sleeve 420. The locking latch 421 has a main body 421*a*, a hook 421*c*, and a locking handle 421*b*. An end of the main body 421*a* is securely attached to the outer sleeve 420. Another end of the main body 421*a* is a free end. The hook 421*c* is formed on an inner sidewall of the main body 421*a* and is disposed at the free end of the main body 421*a*. The hook 421*c* selectively engages in an annular groove 514*a* of the locking assembly 500. The locking handle 421*b* is formed on an outer sidewall of the main body 421*a* and is disposed at the free end of the main body 421*a*. By pulling or pushing the locking handle 421*b*, the hook 421*c* can be controlled to disengage from or engage in the annular groove 541*a* of the locking assembly 500.

Figure 12:
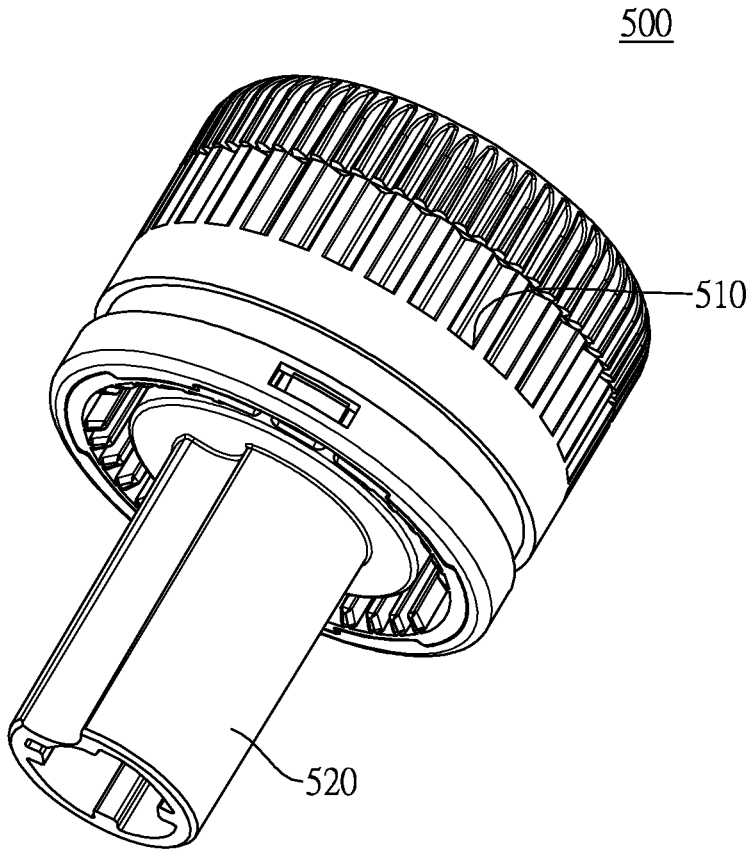
FIG. 12 is a perspective view of a locking assembly of the retractable safety gate in FIG. 1.

With further reference to FIGS. 12 and 15, the locking assembly 500 includes a pressing portion 510 and a transmission portion 520 fitted to the pressing portion 510. The pressing portion 510 and the transmission portion 520 are able to move relative to each other along an axial direction of the transmission portion 520, i.e. an axial direction of the first mounting tube 110, and are able to rotate along a circumferential direction of the transmission portion 520 simultaneously. The transmission portion 520 is securely connected to the upper end of the first mounting tube 110. The pressing portion 510 is mounted through the mounting hole 411 of the fastening bracket 400, and is fitted with the transmission portion 520 and the fastening bracket 400.

When the pressing portion 510 is pressed, the locking assembly 500 is locked with the fastening bracket 400 and the first mounting tube 110 is unable to rotate relative to the fastening bracket 400. When the pressing portion 510 is lifted, the locking assembly 500 is unlocked from the fastening bracket 400. As the pressing portion 510 disengages from the first mounting tube 110, the first mounting tube 110 is able to rotate relative to the fastening bracket 400.

Figure 13:
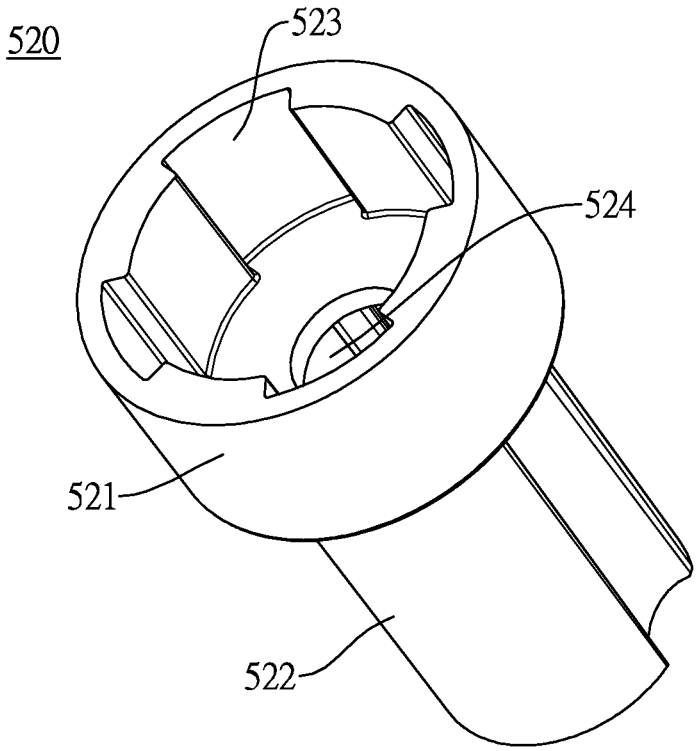
FIG. 13 is a perspective view of a transmission portion of the locking assembly of the retractable safety gate in FIG. 12.

With further reference to FIG. 13, the transmission portion 520 includes a base cylinder 521, a protruding cylinder 522 coaxially protruding from the base cylinder 521, multiple transmission recesses 523, and a guiding hole 524. The protruding cylinder 522 is securely connected to the first mounting tube 110. The transmission recesses 523 are separately formed in and arranged around an inner sidewall of the base cylinder 521. A recess bottom defined in each of the transmission recesses 523 is parallel to an outer sidewall of the base cylinder 521. The guiding hole 524 is formed through a bottom defined in the base cylinder 521.

Figure 14:
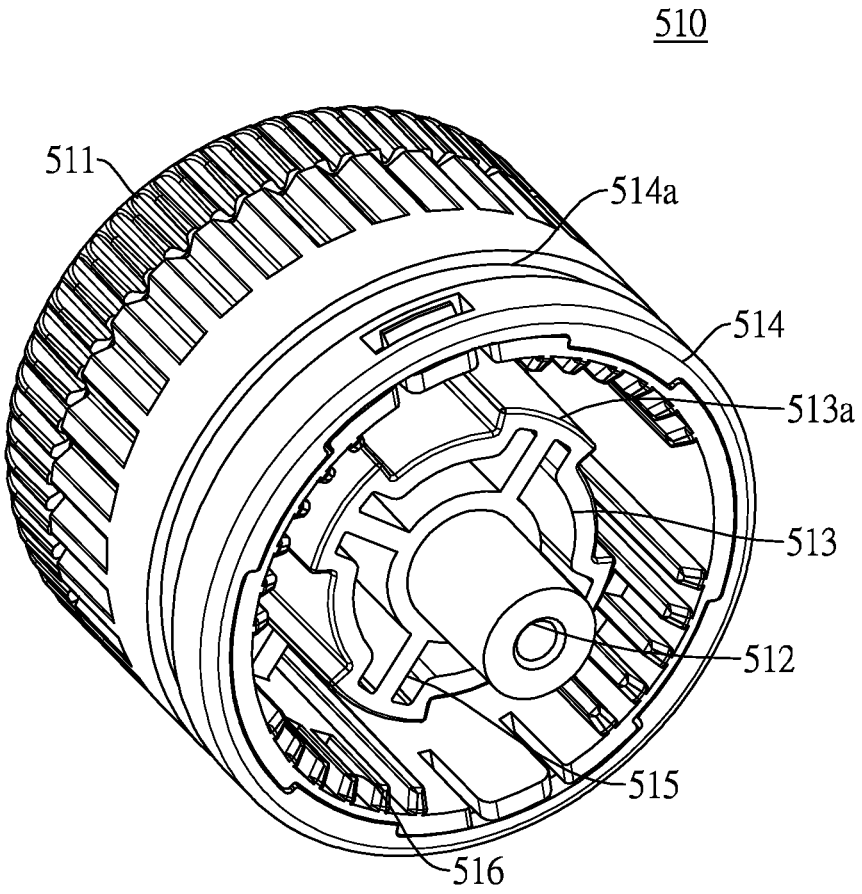
FIG. 14 is a perspective view of a pressing portion of the locking assembly of the retractable safety gate in FIG. 12.

With further reference to FIG. 14, the pressing portion 510 has an inner guiding shaft 512, a middle cylinder 513, an outer cylinder 514, a top end surface 511, and an internal gear 513. The middle cylinder 513 coaxially surrounds the inner guiding shaft 512. An axial length of the inner guiding shaft 512 is longer than an axial length 513 of the middle cylinder 513, and the inner guiding shaft 512 is fitted in the guiding hole 524 of the transmission portion 520. The middle cylinder 513 has multiple transmission protrusions 513*a* formed on an outer sidewall of the middle cylinder 513 and engaging in the transmission recesses 523 of the transmission portion 520 respectively. Multiple reinforcing ribs 515 are separately formed between and are connected to the middle cylinder 513 and the inner guiding shaft 512. The outer cylinder 514 coaxially surrounds the middle cylinder 513. The annular groove 514*a* of the locking assembly 500 is formed in an outer sidewall of the outer cylinder 514 and selectively engages with the locking latch 421. The top end surface 511 is defined above the inner guiding shaft 512, the middle cylinder 513, and the outer cylinder 514. The internal gear 513 is formed around an inner sidewall of the outer cylinder 514 and selectively engages with the external gear 431 of the inner sleeve 430 of the fastening bracket 400.

Figure 7:
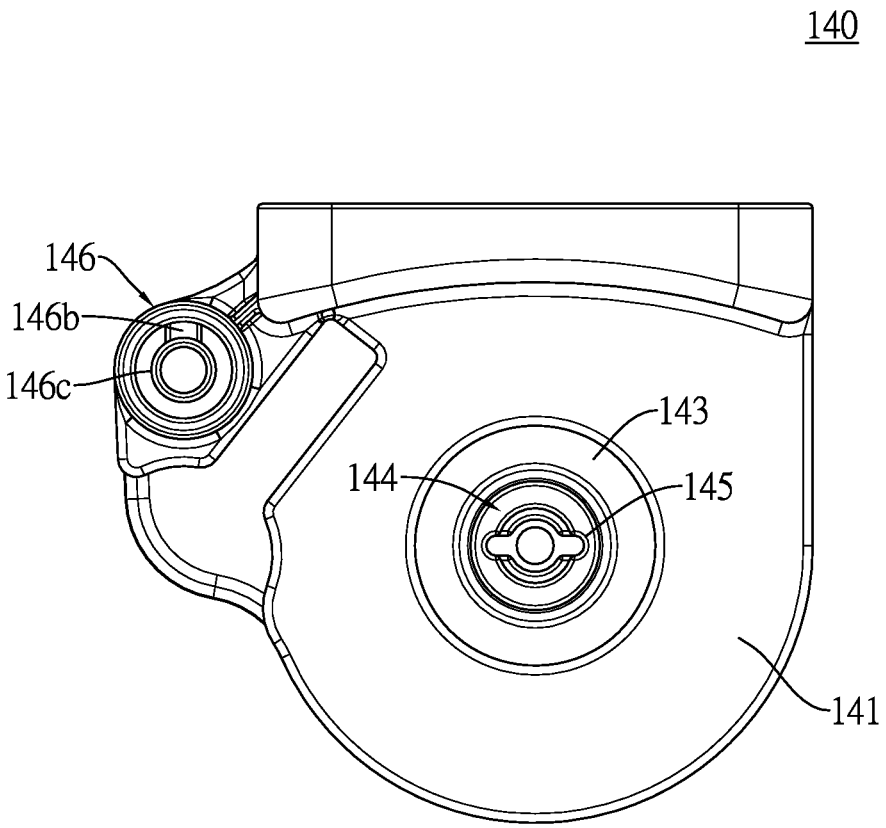
FIG. 7 is a top view of the bottom bracket of the retractable safety gate in FIG. 6.
Figure 8:
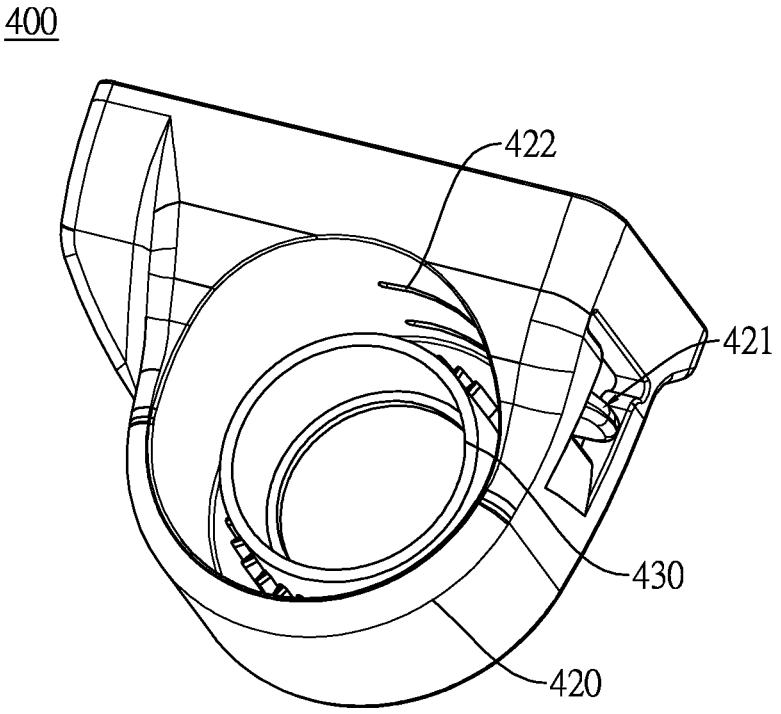
FIG. 8 is a perspective view of a fastening bracket of the retractable safety gate in FIG. 1.
Figure 9:
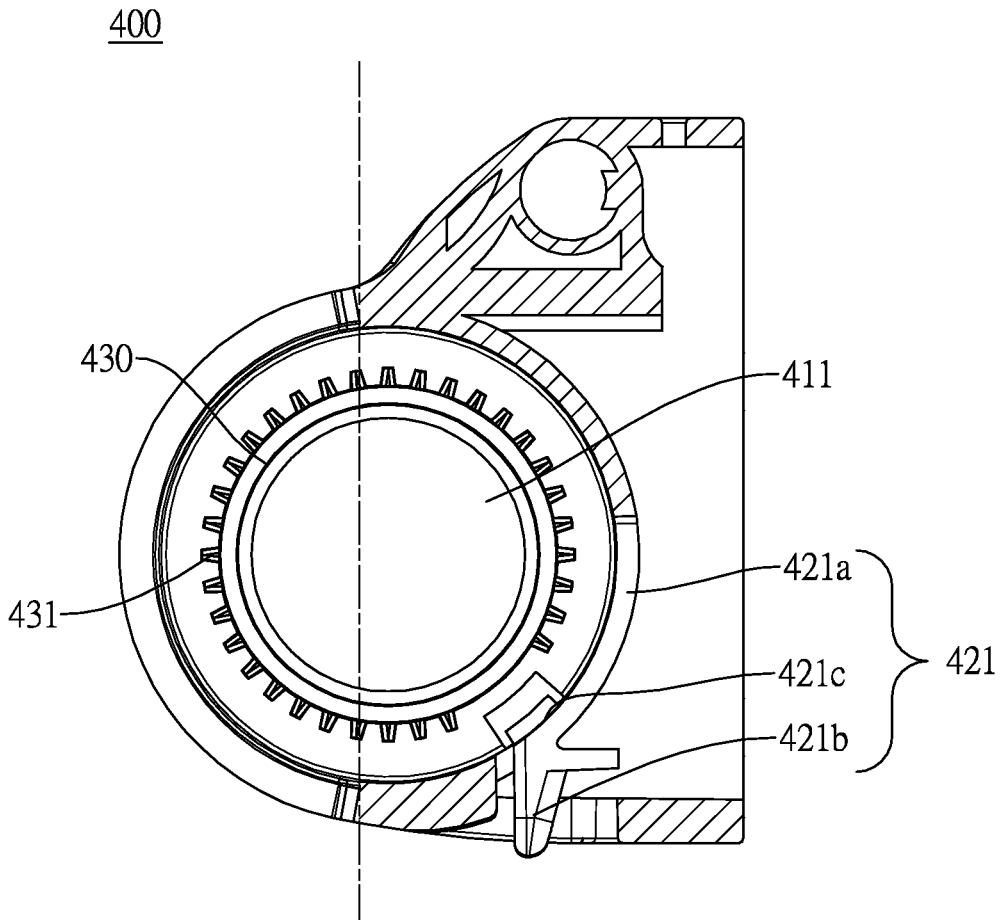
FIG. 9 is a top view in partial section of the fastening bracket of the retractable safety gate in FIG. 8.
Figure 10:
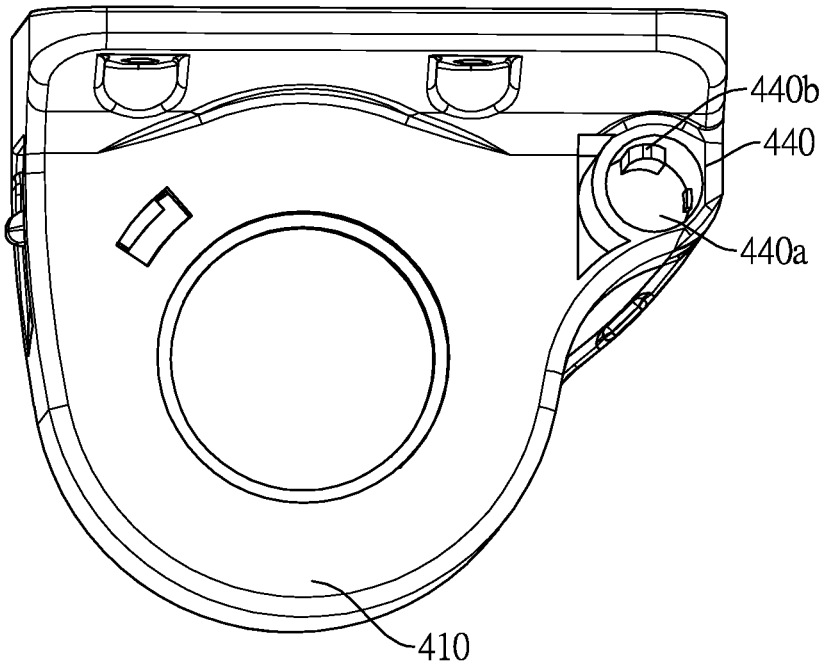
FIG. 10 is a bottom view of the fastening bracket of the retractable safety gate in FIG. 8.
Figure 11:
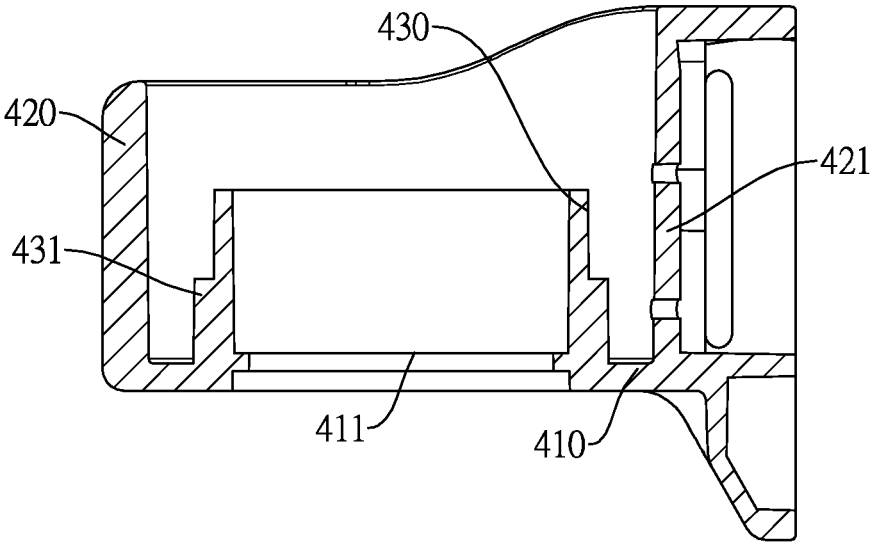
FIG. 11 is a cross-sectional side view of the fastening bracket of the retractable safety gate in FIG. 8.
Figure 16:
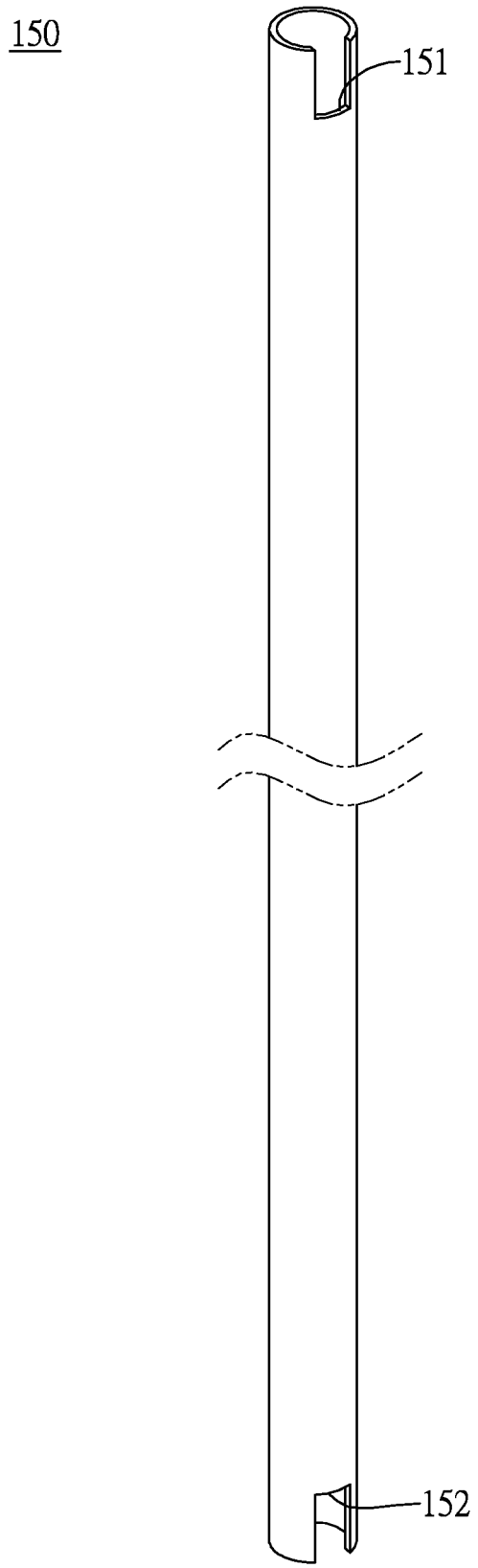
FIG. 16 is a perspective view of a connecting rod of the retractable safety gate in FIG. 1.

With reference to FIGS. 16, 7, and 10, in the preferred embodiment, the retracting mechanism further includes a connecting rod 150. The connecting rod 150 is tubular, and has a lower end and an upper end. The bottom bracket 140 has an assembling portion 146 having a mounting recess 146*a*, a recess wall, and an engaging protrusion 146*b*. The mounting recess 146*a* of the assembling portion 146 of the bottom bracket 140 is formed in the assembling portion 146 of the bottom bracket 140. The recess wall of the assembling portion 146 of the bottom bracket 140 is defined around the mounting recess 146*a* of the assembling portion 146 of the bottom bracket 140. The engaging protrusion 146*b* of the assembling portion 146 of the bottom bracket 140 is formed on the recess wall of the assembling portion 146 of the bottom bracket 140. The fastening bracket 400 has an assembling portion 440 having a mounting recess 440*a*, a recess wall, and an engaging protrusion 440*b*. The mounting recess 440*a* of the assembling portion 440 of the fastening bracket 400 is formed in the assembling portion 440 of the fastening bracket 400. The recess wall of the assembling portion 440 of the fastening bracket 400 is defined around the mounting recess 440*a* of the assembling portion 440 of the fastening bracket 400. The engaging protrusion 440*b* of the assembling portion 440 of the fastening bracket 400 is formed on the recess wall of the assembling portion 440 of the fastening bracket 400.

Furthermore, a positioning post 146*c* protrudes from a bottom defined in the mounting recess 146*a* of the assembling portion 146 of the bottom bracket 140 and is connected with the engaging protrusion 146*b* of the assembling portion 146 of the bottom bracket 140. The lower end of the connecting rod 150 is mounted in the mounting recess 146*a* of the assembling portion 146 of the bottom bracket 140 and around the positioning post 146*c* in the mounting recess 146*a* of the assembling portion 146 of the bottom bracket 140. The connecting rod 150 further has two engaging recesses 151, 152. The engaging recesses 151, 152 are formed in the lower end of the connecting rod 150 and the upper end of the connecting rod 150 respectively and engage with the engaging protrusions 146*b*, 440*b* of the assembling portions 146, 440 of the bottom bracket 140 and the fastening bracket 400 respectively.

Before the retractable safety gate of the present invention is dispatched from the factory, in order to ensure that the resilient element 220 is able to provide sufficient resilient restoring force when rolling the mesh fabric 130 up, the resilient element 220 is deformed in advance and the potential energy is stored therein. Moreover, before the retractable safety gate is installed, the bottom bracket 140 and the fastening bracket 400 are unrestrained and are held by the connecting rod 150. The lower end of the first mounting tube 110 is connected with the bottom bracket 140. The upper end of the first mounting tube 110 is locked in the fastening bracket 400 via the locking assembly 500. Thus, the first mounting tube 110 is not driven to rotate by the resilient element 220 and the transmission element 230 due to the resilient restoring force of the resilient element 220.

With reference to FIGS. 1, 12 to 15, when adjusting an expanding length of the mesh fabric 130, the locking handle 421*b* is pressed to allow the hook 421*c* to disengage from the annular groove 514*a*, such that the locking assembly 500 is released from restriction of the fastening bracket 400. Thus, the pressing portion 510 can be lifted, i.e. the pressing portion 510 is able to move up and down relative to the fastening bracket 400. When the pressing portion 510 is lifted to allow the external gear 431 on the inner sleeve 430 to disengage from the internal gear 516 on the outer cylinder 514, the first mounting tube 110 is able to rotate relative to the fastening bracket 400. When the mesh fabric 130 has been expanded to a predetermined length, the pressing portion 510 is pressed down to allow the external gear 431 to engage with the internal gear 516, the locking assembly 500 is locked with the fastening bracket 400. Since transmission portion 520 of the locking assembly 500 is securely connected with the first mounting tube 110, rotation of the first mounting tube 110 is restrained. Accordingly, the mesh fabric 130 is unable to expand or retract. Then, by pressing the locking handle 421*b* to allow the hook 421*c* to engage with the annular groove 514*a*, movement of the pressing portion 510 is restrained.

When rolling the mesh fabric 130 up, the locking handle 421*b* is pressed again and the pressing portion 510 is lifted to allow the first mounting tube 110 to be released from the locking assembly 500. Thus, the resilient restoring force stored in the resilient element 220 drives the transmission element 230 and the first mounting tube 110 to rotate to wind the mesh fabric 130 around the first mounting tube 110 automatically. Furthermore, in order to ensure that the mesh fabric 130 can be completely wound around the first mounting tube 110, the resilient element 220 is deformed in advance to store the potential energy in the resilient element 220 before the retractable safety gate is dispatched from the factory with the mesh fabric 130 completely wound around the first mounting tube 110. In order to keep the retractable safety gate in a factory default state, the connecting rod 150 is connected between the bottom bracket 140 and the fastening bracket 400 to avoid the fastening bracket 400 and the bottom bracket 140 from rotating relative to each other. That is, the first mounting tube 110 and the bottom bracket 140 do not rotate relative to each other, such that the resilient element 220 also keeps in the factory default state. As the retractable safety gate is installed at a specific place and when intending to rolling the mesh fabric 130 up, the locking assembly 500 is unlocked. Thus, the resilient element 220 drives the first mounting tube 110 to rotate via the transmission element 230. When the mesh fabric 130 is completely wound around the first mounting tube 110, there is still potential energy stored in the resilient element 220.

With reference to FIGS. 1 and 3, the fastening mechanism includes a second mounting tube 120, a first wall fastening bracket 160, a second wall fastening bracket 170, and a switch assembly 600. The second mounting tube 120 is connected to the second side of the mesh fabric 130 and has a first end and a second end. The first wall fastening bracket 160 is detachably connected with the first end of the second mounting tube 120. The second wall fastening bracket 170 is detachably connected with the second end of the second mounting tube 120. The first wall fastening bracket 160 and the second wall fastening bracket 170 are separately fixed onto the other wall or the other barrier, so as to fix the second side of the mesh fabric 130. The switch assembly 600 is mounted on the first end of the second mounting tube 120 and is alternatively connected with or disconnected from the first wall fastening bracket 160 to alternatively close or open the retractable safety gate.

With reference to FIGS. 1, 2, 3, and 19, the switch assembly 600 further includes a handle 610, a push rod assembly 620, and a pushing element 630. The handle 610 is mounted on and around the second mounting tube 120. The push rod assembly 620 is mounted in the second mounting tube 120. The pushing element 630 is connected to the push rod assembly 620 and is exposed to an outside of the handle 610. When the pushing element 630 is pushed, the push rod assembly 620 is moved accordingly to allow a part of the push rod assembly 620 protruding in a receiving recess 161 formed in the first wall fastening bracket 160, so as to connect the second mounting tube 120 with the first wall fastening bracket 160.

Figure 17:
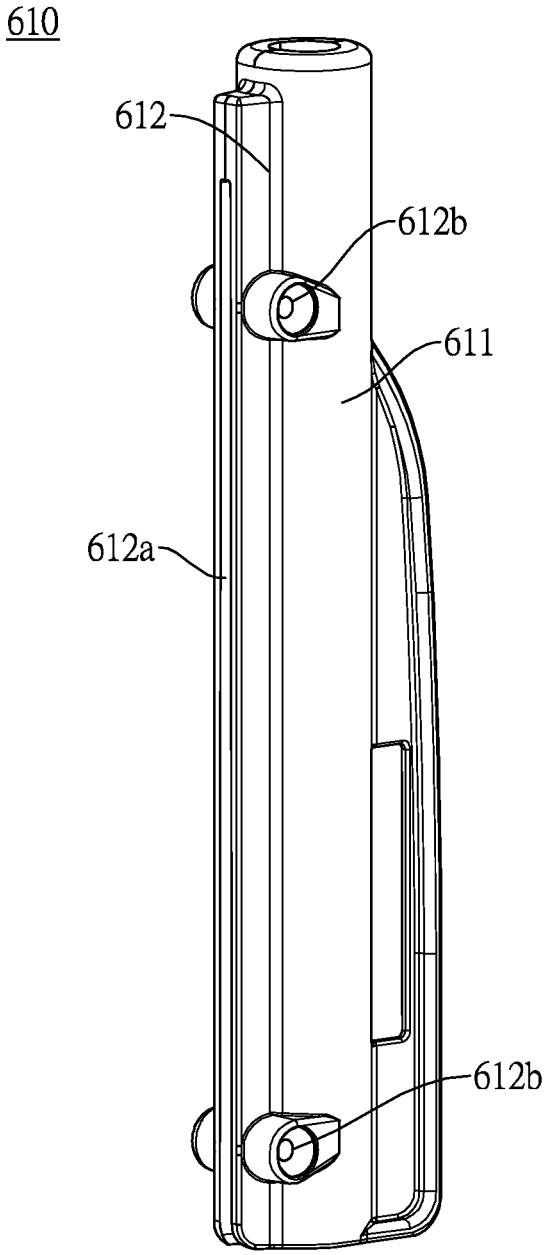
FIG. 17 is a perspective view of a handle of a switch assembly of the retractable safety gate in FIG. 1.

With reference to FIG. 17, the handle 610 has a main tube 611 and a fastening portion 612 formed on the main tube 611. The main tube 611 is mounted around the second mounting tube 120. The fastening portion 612 has a fabric slot 612*a* and multiple holding holes 612*b*. The fabric slot 612*a* is formed in the fastening portion 612 and communicates with the main tube 611. The second side of the mesh fabric 130 is mounted through the fabric slot 612*a*. The holding holes 612*b* are formed through the fastening portion 612. By mounting multiple fasteners through the holding holes 612*b* respectively, the handle 610 is held on the second mounting tube 120.

Figure 18:
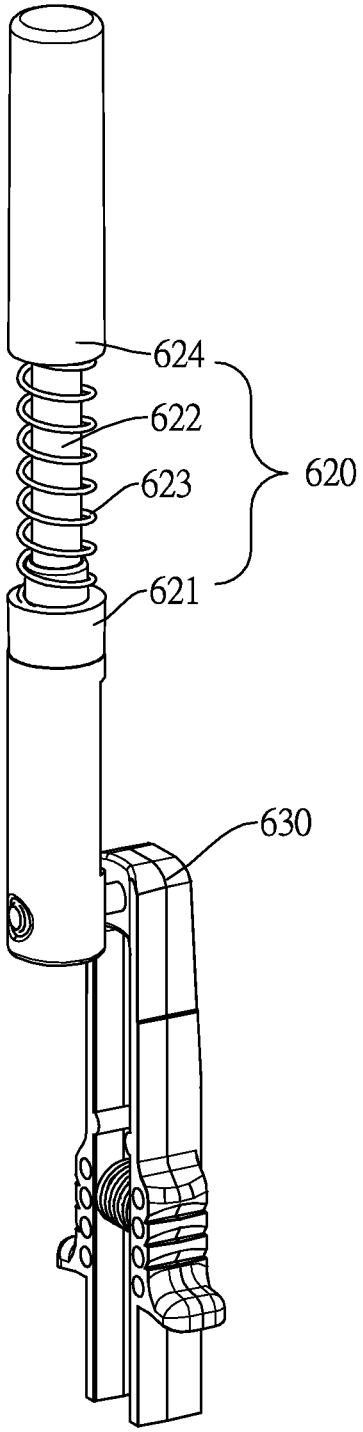
FIG. 18 is a perspective view of a push rod assembly and a pushing element of the switch assembly of the retractable safety gate in FIG. 1.
Figure 19:
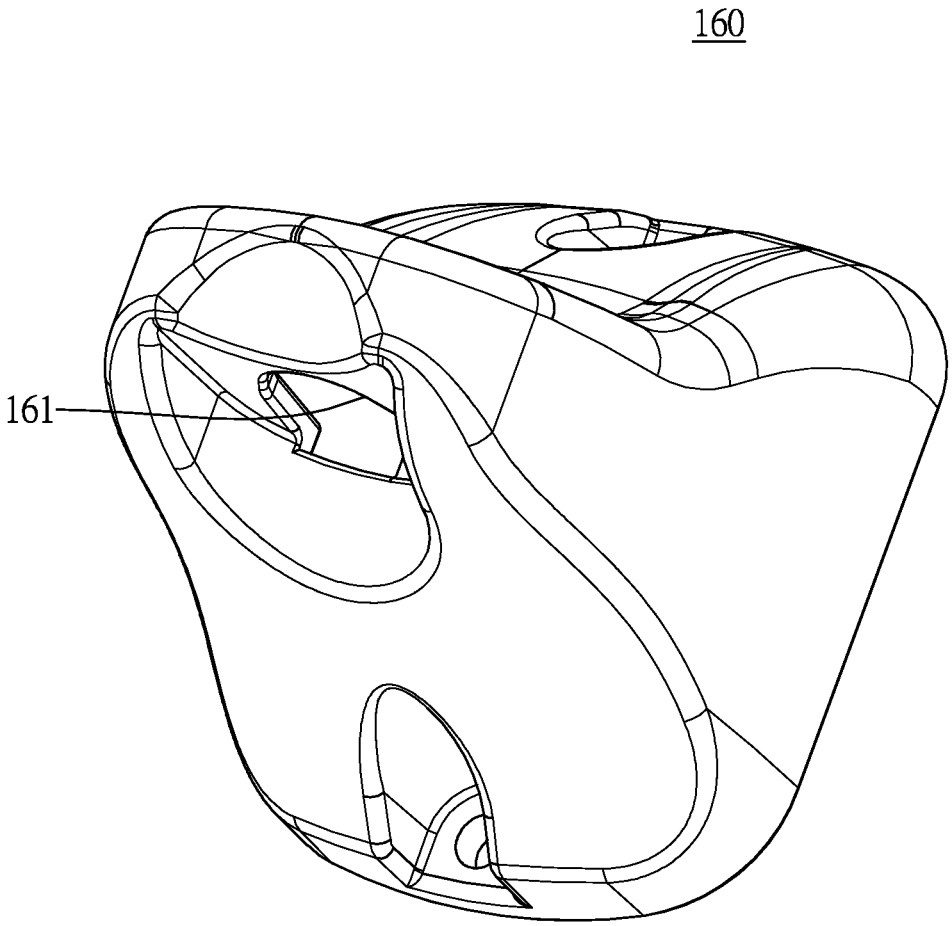
FIG. 19 a perspective view of a first wall fastening bracket of the retractable safety gate in FIG. 1.

With reference to FIGS. 3, 18, and 19, the push rod assembly 620 includes a fitting element 621, a central rod 622, an end cap 624, and a spring 623. The fitting element 621 is connected with the pushing element 630. The central rod 622 is movably connected with the fitting element 621. The end cap 624 is mounted around the central rod 622. The spring 623 is mounted around the central rod 622, is disposed between the fitting element 621 and the end cap 624, and has two ends respectively connected to the fitting element 621 and the end cap 624. When protruding the end cap 624 into the first wall fastening bracket 160, the spring 623 is compressed and a total length of the push rod assembly 620 is shortened. Thus, the end cap 624 is able to slide into the receiving recess 161 of the first wall fastening bracket 160. As the end cap 624 has protruded in the receiving recess 161 of the first wall fastening bracket 160, the spring 623 is restored to its original state. Accordingly, the end cap 624 is held by the first wall fastening bracket 160 and does not slide out of the receiving recess 161 of the first wall fastening bracket 160.

When the retractable safety gate of the present invention is closed, the end cap 624 is inserted in the receiving recess 161 of the first wall fastening bracket 160. The spring 623 that is compressed forms a resilient restoring force to push the pushing element 630 to move downward and push the fitting element 621 to move upward. Thus, as the spring 623 is compressed, the end cap 624 is unable to slide up and down relative to the first wall fastening bracket 160. Accordingly, the end cap 624 remains being inserted in the receiving recess 161 to ensure that the retractable safety gate does not open unexpectedly.

When opening the retractable safety gate of the present invention, the pushing element 630 is pressed to be pushed downward. Accordingly, the fitting element 621, the spring 623, and the end cap 624 are moved downward to allow the end cap 624 to disengage from the receiving recess 161 of the first wall fastening bracket 160. Thus, the retractable safety gate is opened.

Moreover, the first mounting tube 110 further has a fabric recess formed in the outer sidewall of the first mounting tube 110. A pressing bar 113 is mounted in the fabric recess, is connected to the bottom bracket 140 and the tube plug 111, and may be made of steel or plastic. When the mesh fabric 130 is being expanded and the first mounting tube 110 rotates, the mesh fabric 130 wound around the first mounting tube 110 would loosened from the first mounting tube 110 instead of compactly wound around the first mounting tube 110. Meanwhile, when the mesh fabric 130 is expanded to a predetermined length, the pressing bar 113 forms a pressing force between outer loops and inner loops of the mesh fabric 130 that is wound around the first mounting tube 110. The inner loops of the mesh fabric 130 that is restrained by the pressing bar 113 does not loosened from the first mounting tube 110.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A retractable safety gate comprising:

a mesh fabric having a first side and a second side;

a retracting mechanism connected with the first side of the mesh fabric and including:

a bottom bracket having an assembling portion, and the assembling portion of the bottom bracket having:

a mounting recess formed in the assembling portion of the bottom bracket;

a recess wall defined around the mounting recess of the assembling portion of the bottom bracket; and an engaging protrusion formed on the recess wall of the assembling portion of the bottom bracket;

a fastening bracket having an assembling portion, and the assembling portion of the fastening bracket having:

a mounting recess formed in the assembling portion of the fastening bracket;

a recess wall defined around the mounting recess of the assembling portion of the fastening bracket; and an engaging protrusion formed on the recess wall of the assembling portion of the fastening bracket;

a connecting rod disposed between and securely connected to the bottom bracket and the fastening bracket to fix a relative position of the bottom bracket and the fastening bracket, and the connecting rod having:

a lower end mounted in the mounting recess of the assembling portion of the bottom bracket;

an upper end mounted in the mounting recess of the assembling portion of the fastening bracket; and two engaging recesses formed in the lower end of the connecting rod and the upper end of the connecting rod respectively and engaging with the engaging protrusions of the assembling portions of the bottom bracket and the fastening bracket respectively;

a first mounting tube disposed between the bottom bracket and the fastening bracket and having:

a lower end rotatably mounted in the bottom bracket; and an upper end rotatably mounted in the fastening bracket;

wherein the first side of the mesh fabric is connected to and is wound around the first mounting tube;

a locking assembly mounted on the upper end of the first mounting tube and selectively engaging with the fastening bracket, wherein the locking assembly disengages from the fastening bracket when adjusting an expanded length of the mesh fabric, and the expanded length of the mesh fabric is fixed when the locking assembly engages with the fastening bracket; and an energy storage assembly mounted in the first mounting tube and including:

a central tube having a lower end securely connected to the bottom bracket;

a transmission element rotatably mounted around the central tube and securely connected with the first mounting tube; and a resilient element having two ends, and the ends of the resilient element connected to the central tube and the transmission member respectively, wherein a resilient restoring force is formed when the resilient element is deformed, and the resilient restoring force drives the first mounting tube to rotate to wind the mesh fabric around the first mounting tube; and a fastening mechanism connected with the second side of the mesh fabric.

2. The retractable safety gate as claimed in claim 1, wherein the assembling portion of the bottom bracket further has:

a bottom defined in the mounting recess of the assembling portion of the bottom bracket; and a positioning post protruding from the bottom of the assembling portion of the bottom bracket;

the connecting rod further is tubular; and the lower end of the connecting rod is mounted around the positioning post of the assembling portion of the bottom bracket.

3. The retractable safety gate as claimed in claim 1, wherein the fastening bracket has an outer sleeve;

an inner sleeve surrounded by the outer sleeve;

an upper end surface defined under the outer sleeve and the inner sleeve and facing the bottom bracket;

an external gear formed around an outer sidewall of the inner sleeve; and a mounting hole formed through the upper end surface of the fastening bracket; and the locking assembly is mounted through the mounting hole of the fastening bracket and is connected to the upper end of the first mounting tube.

4. The retractable safety gate as claimed in claim 3, wherein the locking assembly includes a pressing portion having:

an inner guiding shaft;

a middle cylinder coaxially surrounding the inner guiding shaft;

an outer cylinder coaxially surrounding the middle cylinder;

a top end surface defined above the inner guiding shaft, the middle cylinder, and the outer cylinder; and an internal gear formed around an inner sidewall of the outer cylinder and selectively engaging with the external gear of the fastening bracket.

5. The retractable safety gate as claimed in claim 4, wherein the locking assembly further includes a transmission portion fitted to the pressing portion and having:

a base cylinder;

a protruding cylinder coaxially protruding from the base cylinder and securely connected to the first mounting tube; and multiple transmission recesses separately formed in and arranged around an inner sidewall of the base cylinder; and the middle cylinder of the pressing portion further has multiple transmission protrusions formed on an outer sidewall of the middle cylinder and engaging in the transmission recesses of the transmission portion respectively.

6. The retractable safety gate as claimed in claim 1, wherein the fastening mechanism includes:

a second mounting tube connected to the second side of the mesh fabric and having a first end and a second end;

a first wall fastening bracket detachably connected with the first end of the second mounting tube;

a second wall fastening bracket detachably connected with the second end of the second mounting tube; and a switch assembly mounted on the first end of the second mounting tube and alternatively connected with or disconnected from the first wall fastening bracket to alternatively close or open the retractable safety gate.

7. The retractable safety gate as claimed in claim 6, wherein the switch assembly further includes:

a handle mounted on and around the second mounting tube;

a push rod assembly mounted in the second mounting tube; and a pushing element connected to the push rod assembly and exposed to an outside of the handle;

wherein when the pushing element is pushed, the push rod assembly is moved accordingly to allow a part of the push rod assembly protruding in the first wall fastening bracket, so as to connect the second mounting tube with the first wall fastening bracket.

8. The retractable safety gate as claimed in claim 7, wherein the push rod assembly includes:

a fitting element connected with the pushing element;

a central rod movably connected with the fitting element;

an end cap mounted around the central rod; and a spring mounted around the central rod, disposed between the fitting element and the end cap, and having two ends respectively connected to the fitting element and the end cap.

* * * * *